US006892976B2

(12) United States Patent
Foo et al.

(10) Patent No.: US 6,892,976 B2
(45) Date of Patent: May 17, 2005

(54) SEMICONDUCTOR ASSEMBLY METHOD AND EQUIPMENT THEREFOR

(75) Inventors: Kha Choy Foo, Seremban Negeri Sembilan (MY); Letchumanan Kumaroviloo, Senawang Seremban (MY)

(73) Assignee: Semiconductor Components Industries, L.L.C., Phoenix, AZ (US)

( * ) Notice: Subject to any disclaimer, the term of this patent is extended or adjusted under 35 U.S.C. 154(b) by 10 days.

(21) Appl. No.: 10/623,870

(22) Filed: Jul. 18, 2003

(65) Prior Publication Data

US 2005/0011986 A1 Jan. 20, 2005

(51) Int. Cl.[7] ..... B65B 61/00

(52) U.S. Cl. ..... 242/531; 242/580; 242/531.1; 242/532.3; 156/184

(58) Field of Search ..... 242/531, 580, 242/160.2, 532.3, 531.1; 156/184, 191, 459

(56) References Cited

U.S. PATENT DOCUMENTS

| | | | | | |
|---|---|---|---|---|---|
| 1,967,920 | A | * | 7/1934 | Baxenden et al. | 242/611.2 |
| 3,658,614 | A | * | 4/1972 | Beck | 156/187 |
| 4,351,687 | A | * | 9/1982 | Lesage | 156/353 |
| 5,169,479 | A | * | 12/1992 | Hoddinott et al. | 156/355 |
| 5,256,232 | A | * | 10/1993 | Fuss et al. | 156/187 |
| 5,413,656 | A | * | 5/1995 | Kuhnhold et al. | 156/184 |
| 5,524,844 | A | * | 6/1996 | McCormick et al. | 242/562 |

* cited by examiner

*Primary Examiner*—Kathy Matecki
*Assistant Examiner*—Sang Kim
(74) *Attorney, Agent, or Firm*—Robert F. Hightower

(57) ABSTRACT

An automatic reel changer (10) for a tape-and-reel handler is formed to automatically insert a carrier tape (15) from the tape-and-reel handler into an empty receiving reel (80), wind the carrier tape (15) onto the receiving reel (80), and apply a securing device to keep the carrier tape (15) fixedly attached to the receiving reel (80). The automatic reel changer (10) then removes the full receiving reel (80) and replaces it with another empty receiving reel (81) and continues the process.

20 Claims, 6 Drawing Sheets

SEMICONDUCTOR ASSEMBLY METHOD AND EQUIPMENT THEREFOR

BACKGROUND OF THE INVENTION

The present invention relates, in general, to electronics, and more particularly, to assembly equipment and methods therefor.

In the past, semiconductor assembly equipment manufacturers utilized various methods and equipment to produce tape and reel assembly equipment, such as semiconductor die to tape assembly handlers. Typically a reel containing empty tape positions is mounted onto the handler and the handler inserts a semiconductor die into each empty position and winds the assembled tape onto an empty receiving reel. Such tape and real assembly equipment is well known in the art. One problem with these previous tape and reel handlers was the amount of time required to place an empty real on the handler to receive the assembled tape and the amount of time required to remove a full reel after an assembly run. Typically each receiving reel was capable of holding a length of tape containing three thousand to ten thousand tape positions. Once the reel was full, the handler was stopped, the full receiving real was manually removed, a securing device was manually attached to the wound-up tape, and another empty receiving wheel was manually position on the handler to receive the next length of tape. The full tape exiting the handler was manually inserted into the empty reel so that the handler could wind the full tape onto the reel. All of the manual operation including manually installing and removing the receiving reels increased the time and costs of the assembly process.

Accordingly, it is desirable to have a reel assembly method that reduces the amount of time required to install a new empty receiving reel, to remove a full receiving reel, and that reduces the manufacturing cost.

BRIEF DESCRIPTION OF THE DRAWINGS

For simplicity and clarity of illustration, elements in the figures are not necessarily to scale, and the same reference numbers in different figures denote the same elements. Additionally, descriptions and details of well known steps and elements are omitted for simplicity of the description.

DETAILED DESCRIPTION OF THE DRAWINGS

Figure 1:
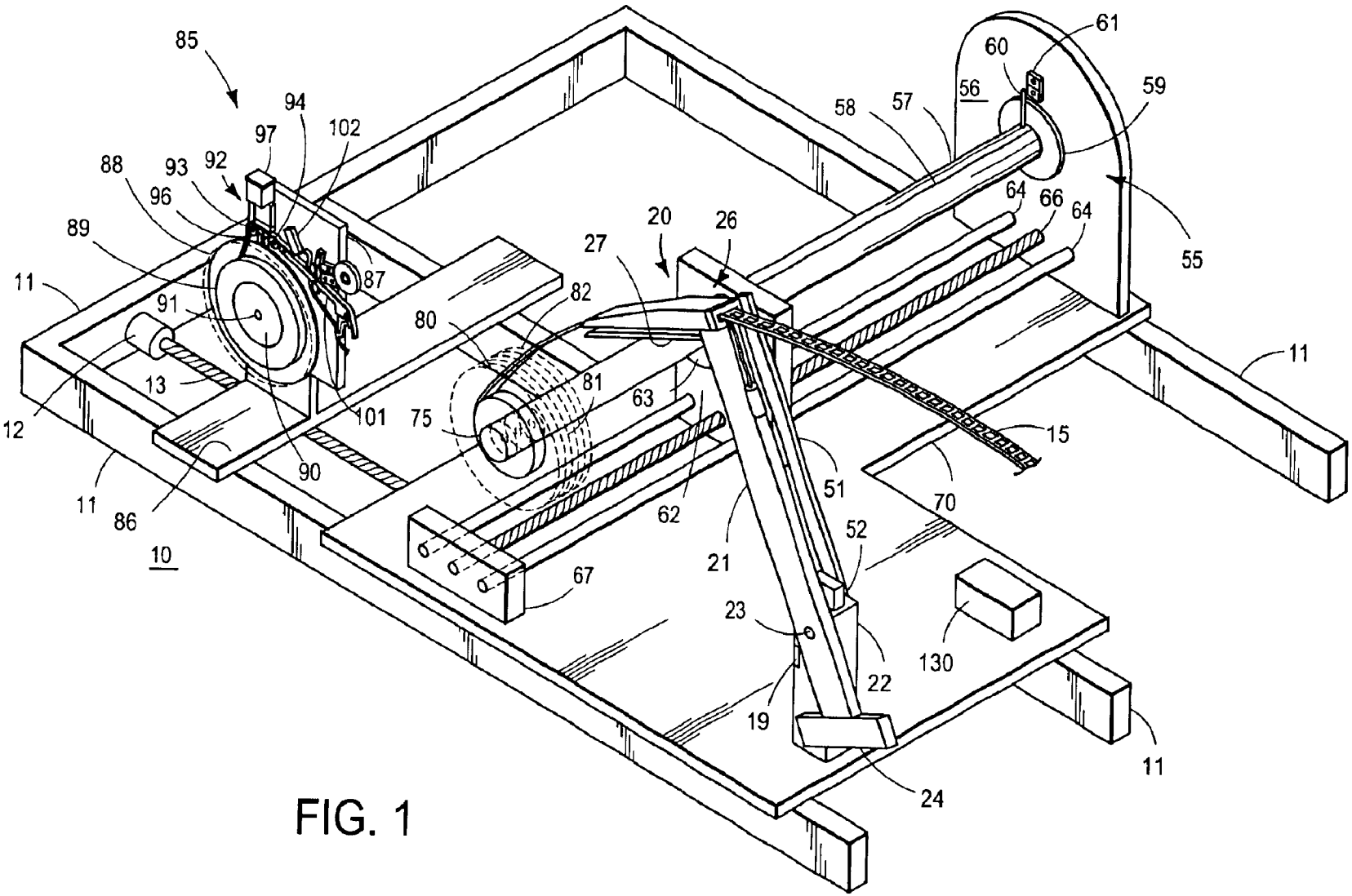
FIG. 1 schematically illustrates a reduced isometric view of a portion of an embodiment of an automated reel changer for a tape and reel handler in accordance with the present invention.

FIG. 1 schematically illustrates a reduced isometric view of a portion of an embodiment of an automated reel changer 10 that reduces the manufacturing time of tape and reel assembly operations. Automated reel changer 10 accepts lengths of carrier tape, preferably assembled with semiconductor die, from a tape and reel handler (not shown), winds the completed length of carrier tape onto an empty receiving reel, attaches a securing device to the rolled carrier tape, removes the full receiving reel from changer 10, and positions another empty receiving reel to receive a another length of carrier tape from the tape and reel handler hereinafter referred to as the handler. Changer 10 includes a loader module 20, a reel changer module 55, and a securing module 85. Changer 10 also includes a control system or control processor 130 such as a programmable logic controller, or a micro-processor system, or other similar control system that receives various signals from sensors on changer 10 and responsively controls motors and other actuators of changer 10 in a manner as described hereinafter. For simplicity, processor 130 is shown in an enclosure attached to a portion of changer 10 but may be located elsewhere. Modules 20, 55, and 85 are identified in a general way by arrows. Modules 20 and 55 are assembled to a baseplate 70 that is secured to and supported by a supporting structure such as a frame 11 or other similar supporting structure. A plurality of receiving reels 80, 81, and 82 typically are loaded as a plurality of empty receiving reels onto a reel shaft 57 of reel changer module 55. Typically, plurality of reels 80, 81, and 82 are manually loaded onto module 55. Module 55 can accept more than three reels but only three are shown for clarity of the drawings. In the preferred embodiment, fifteen empty receiving reels are loaded onto reel shaft 57. Reels 80, 81, and 82 are shown as dashed lines in FIG. 1 for clarity of the drawing and explanation. Module 85 includes a backplate 87, a drive motor 12, and a drive screw 13. Module 85 is built on a baseplate 86 that is slidingly mounted on the supporting structure, such as frame 11, to allow module 85 to slidingly move into contact with a full receiving reel, apply the securing device to the carrier tape wound onto the receiving reel, and to sliding move away from the full receiving reel. Changer 10 is positioned juxtaposed to the handler so that loader module 20 may receive a first end of a carrier tape 15 as it exits the handler. Loader module 20 grasps the first end of carrier tape 15, inserts the first end of tape 15 into empty receiving reel 80, then releases the tape 15 so that tape 15 may wind onto reel 80. After module 20 releases the end of tape 15, module 55 rotates reel 80 until tape 15 is wound onto reel 80. Module 85 then moves into a position contacting reel 80 and secures a second end of tape 15 to prevent tape 15 from unwinding. After tape 15 is secured, module 85 moves back away from reel 80. Reel changer module 55 then removes reel 80 and positions an empty second receiving reel 81 into position to receive another carrier tape 15 from the handler and from module 20.

Loader module 20 includes a head assembly 26 that is attached to a proximate end of a pivot arm or loader arm 21. Arm 21 is pivotally attached to a support 22 so that arm 21 may rotate head assembly 26 from a position near the handler to a position contacting the axle of reel 80. In the preferred embodiment, support 22 is attached to baseplate 70 and extends vertically from a surface of baseplate 70.

Arm 21 is attached to support 22 by a shaft 23 that extends through a bearing in support 22. Shaft 23 is connected to a drive motor (not shown) mounted on the back side of support 22. In the preferred embodiment, the drive motor is a DC motor that can move arm 21 both clockwise and counter-clockwise as required. The bearing allows arm 21 to rotate freely when the motor drives shaft 23 and arm 21. A proximity sensor 19 senses the position of arm 21 and is used in controlling the motion of arm as will be seen hereinafter. In the preferred embodiment, two sensors 19 are mounted on arm 21 with each sensor 19 positioned to operate arm 21 for one of two different sizes of reel 80. Arm 21 must move a different distance for a ten thousand unit tape than for a three thousand unit tape. A counterweight 24 is attached to a distal end of arm 21 in order to counterbalance the weight of head assembly 26. A spreader 27 is mounted on arm 21 and displaced a vertical distance parallel to head assembly 26. As head assembly 26 rotates down toward reel 80, spreader 27 goes in between the sides of reel 80 spreading reel 80 apart to ensure that module 20 can insert tape 15 into reel 80.

Figure 2:
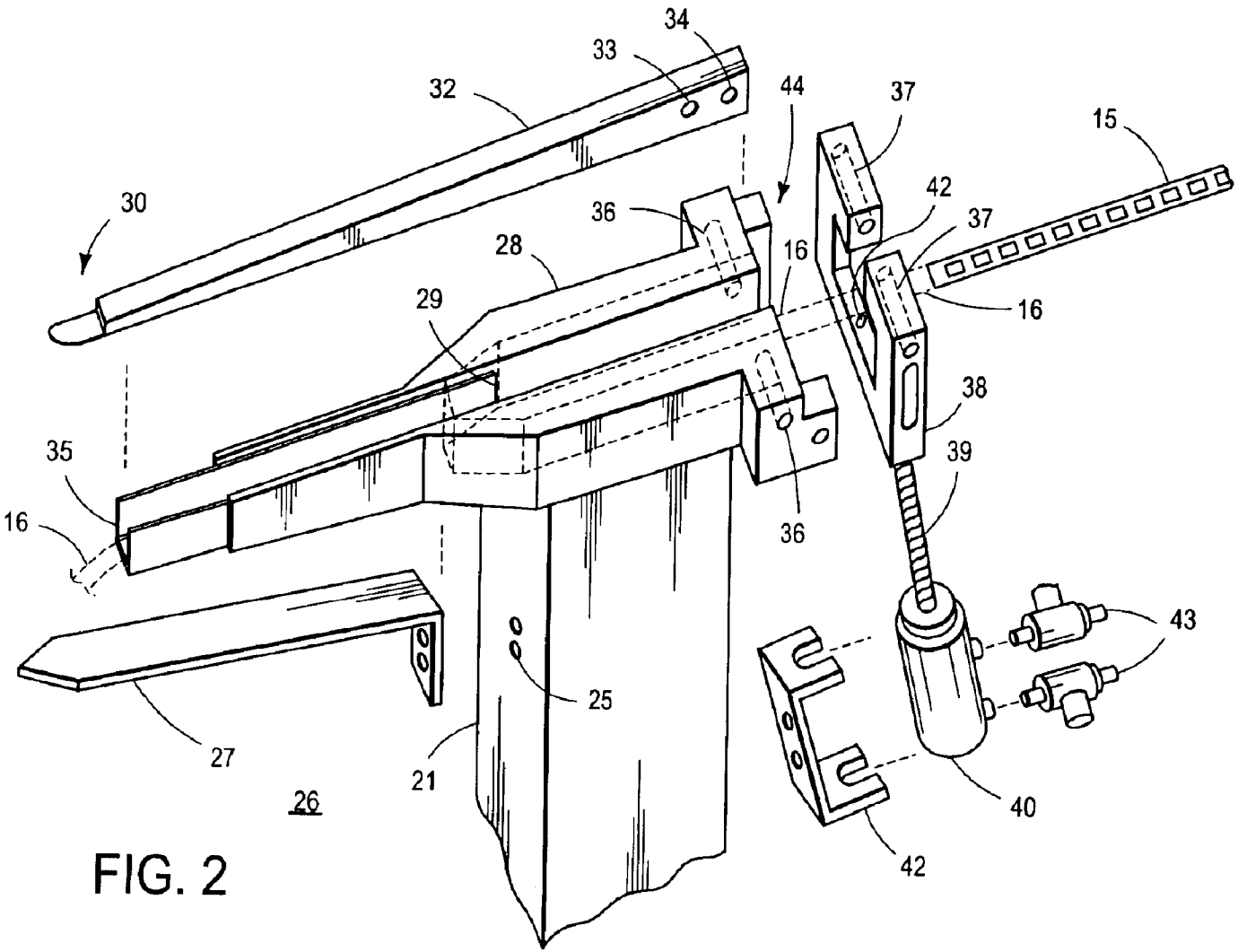
FIG. 2 schematically illustrates a reduced exploded isometric view of an embodiment of a portion of the automated reel changer of FIG. 1 in accordance with the present invention.

FIG. 2 schematically illustrates an exploded isometric view of an embodiment of a portion of head assembly 26. For clarity, this description has references to both FIG. 1 and FIG. 2. Head assembly 26 receives a first end of tape 15 from the handler typically after semiconductor devices are inserted into positions in tape 15. The path of carrier tape 15 up to assembly 26 is illustrated by dashed lines 16. Assembly 26 has a body 28 with a channel 29 that runs longitudinally through body 28. Channel 29 has an opening 44 at a proximal end of body 28. Opening 44 is wider than the width of channel 29 at a distal end 35 of body 28 to ensure that tape 15 will be inserted into channel 29 and to allow tape 15 to slide through channel 29 to distal end 35. The width of opening 44 tapers down to the same width as end 35 around the mid-point of channel 29. Thus, opening 44 and channel 29 form a receiving chamber to receive tape 15 from the handler. Body 28 typically is formed from a stiff material such as aluminum. Distal end 35 of body 28 has a width that permits inserting distal end 35 into reel 80. A gripper 32 is formed as a length of spring material, such as spring steel, that fits into channel 29 so that tape 15 slides between gripper 32 and the bottom of channel 29. A pair of mounting holes 36 through body 28 and a mounting hole 33 through gripper 32 facilitate attaching gripper 32 to body 28. Gripper 32 is attached in a manner that allows gripper 32 to rotate around the attachment at holes 36. Typically pins are inserted through holes 33 and 36 to form the attachment. An actuator mechanism attaches to a proximal end of gripper 32 and causes gripper 32 to rotate around the attachment at holes 36 so that a distal end 30 of gripper 32 may apply pressure to grasp tape 15 between gripper 32 and body 28 in order to hold tape 15 while module 20 rotates assembly 26 to insert the first end of tape 15 into reel 80. The actuator includes a hydraulic or pneumatic cylinder 40 that has a shaft 39 attached to an actuator bracket 38. In the preferred embodiment, bracket 38 has a shape that is similar to a cross section of body 28 and has a center opening that is larger than opening 44. This larger opening in bracket 38 assists in guiding tape 15 through the opening and into channel 29 without any interference from bracket 38. Actuator bracket 38 has a pair of mounting holes 37 through bracket 38 that enable bracket 38 to attach to the proximal end of gripper 32 through a hole 34 that is through gripper 32. Typically a pin or other attachment device is inserted through holes 37 and 34 in order to attach bracket 38 to gripper 32. Cylinder 40 is attached to arm 21 at a mounting hole 42. A pair of valve bodies 43 are connected to cylinder 40 in order to facilitate the hydraulic or pneumatic movement of bracket 38. When cylinder 40 is actuated, bracket 38 is pushed away from cylinder 40 and lifts the proximal end of gripper 32 causing distal end 30 to grasp tape 15 between distal end 30 and the bottom of channel 29. Distal end 35 of body 28 and channel 29 is at an end opposite to that where bracket 38 is located.

Spreader 27 is attached to arm 21 through mounting holes 25. A distal end of spreader 27 is tapered or pointed in order to facilitate spreading open the sides of reel 80 as assembly 26 moves into reel 80 to insert the end of tape 15 into reel 80. Spreader 27 typically is slightly shorter than body 28 to ensure spreader 27 does not contact the center of reel 80.

Figure 3:
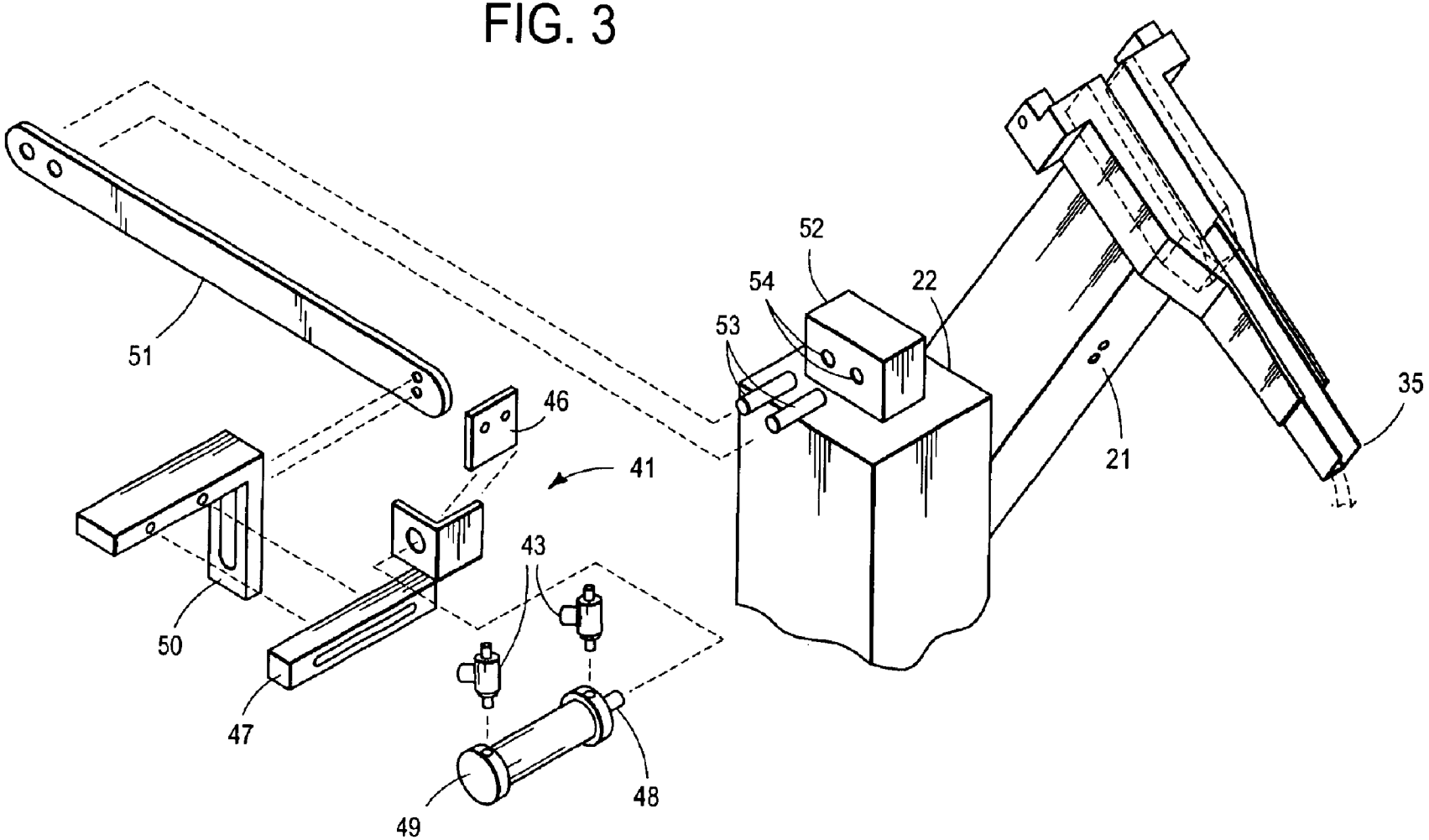
FIG. 3 schematically illustrates a reduced exploded isometric view of an embodiment of another portion of the automated reel changer of FIG. 1 in accordance with the present invention.

FIG. 3 schematically illustrates a reduced exploded isometric view of a portion of an embodiment of a sensor assembly 41 of module 20. For clarity, this description has references to FIG. 3, FIG. 2, and FIG. 1. As will be seen hereinafter, sensor assembly 41 includes a sensor 46 that is used to detect the presence and position of the first end of tape 15 as tape 15 reaches distal end 35 of head assembly 26. In the preferred embodiment, sensor 46 is an optical sensor. The remainder of sensor assembly 41 functions to move sensor 46 in front of channel 29 prior to or concurrent with tape 15 moving through assembly 26 and channel 29. Thus, assembly 41 functions to move sensor 46 into the path of tape 15 in order to sense tape 15. Sensor assembly 41 mounts onto holes on support 22 so that sensor 46 is positioned in a plane parallel to distal end 35 but set off to a side of body 28. In the preferred embodiment, a support arm 51 is attached to support 22 with a spacer block 52 and a pair of spacers 53. Spacers 53 generally are positioned between block 52 and arm 51 and screws attach arm and spacers 53 to holes 54 in block 52.

Sensor 46 is attached to a sensor slider 47. Slider 47 has an elongated slot through which screws slidingly attach slider 47 to a sensor support 50. The elongated slot facilitates slider 47 sliding along the long face of support 50 perpendicularly to arm 51. Support 50 is rigidly attached to arm 51. A hydraulic or pneumatic cylinder 49 is rigidly attached to support 50. A shaft 48 of cylinder 49 attaches to an opening in slider 47 so that slider 47 is moved in front of distal end 35 of channel 29 when cylinder 49 is activated. Slider 47 is returned back to the starting position when cylinder 49 is de-activated. Another pair of valve bodies 43 are attached to cylinder 49 in order to activate and de-activate cylinder 49.

Figure 4:
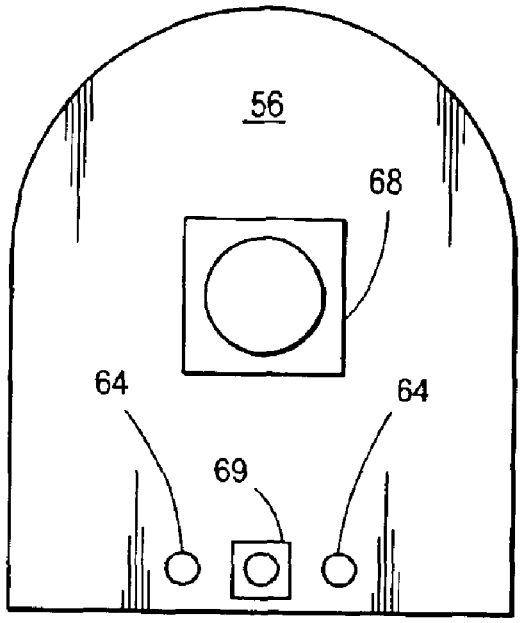
FIG. 4 schematically illustrates a reduced rear elevation view of an embodiment of a portion of the automated reel changer of FIG. 1 in accordance with the present invention.

FIG. 4 schematically illustrates a reduced rear elevation view of an embodiment of a portion of reel changer module 55 that was illustrated in FIG. 1.

Figure 5:
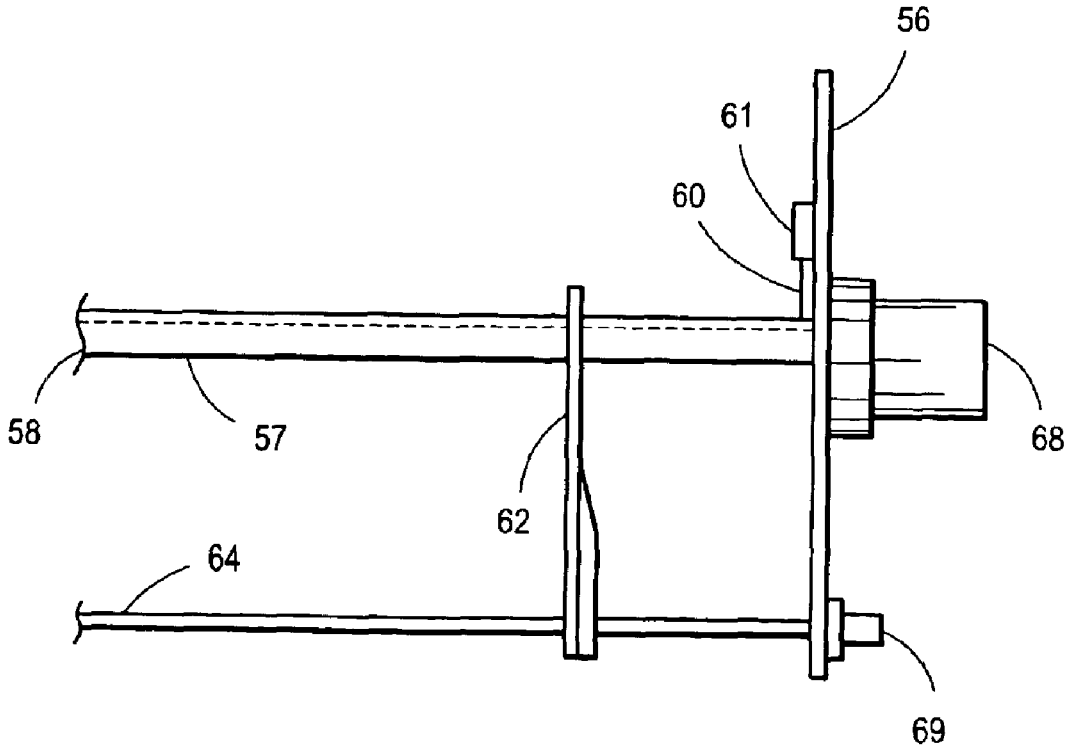
FIG. 5 schematically illustrates a reduced side elevation view of the embodiment of FIG. 4 in accordance with the present invention.

FIG. 5 schematically illustrates a reduced side elevation view of an embodiment of another portion of reel changer module 55 that is illustrated in FIG. 1 and FIG. 4. This description has references to FIG. 5, FIG. 4, and FIG. 1 for clarity of the description. Module 55 includes a changer module backplate 56 that is rigidly attached to baseplate 70. Backplate 56 is utilized to support and facilitate rotationally driving shaft 57, and to support a rotational sensor 61 that senses the position of shaft 57. As shown in FIG. 1, backplate 56 has an opening in which a bearing (FIG. 1) is positioned to support shaft 57 and facilitate rotation of shaft 57. FIG. 1 further illustrates that a key 58 is inserted into a keyway that extends axially along the length of shaft 57. Each receiving reel 80 has a slot in the center opening or axle of the reel to facilitate shaft 57 rotationally driving reel 80. As shown in FIG. 4, a drive motor 68 is mounted on the backside of backplate 56 and attached to an end of shaft 57 in order to rotationally drive shaft 57, reel 80, and the plurality of receiving reels. Rotation sensor 61 is mounted on backplate 56 to sense the rotation of shaft 57 and reel 80. In the preferred embodiment, sensor 61 is a slotted optical sensor. In this preferred embodiment, a position plate having a finger like protrusion 60 is attached to shaft 57 so that protrusion 60 extends radially from shaft 57 and is positioned axially to key 58. Each time key 58 rotates past sensor 61 protrusion 60 passes through sensor 61 and sensor 61, responsively provides a signal indicating the position of shaft 57.

Module 55 also includes a reel positioner 62 that slides longitudinally along shaft 57. Positioner 62 is used to move the plurality of receiving reels axially along shaft 57 and to also eject the receiving reel after the receiving reel is full of carrier tape 15. A pair of positioning guides 64 are used to guide and support positioner 62 as it slides axially along shaft 57. Using a pair of guides 64 assists in keeping positioner 62 parallel to the plurality of receiving reels. A first end of each guide 64 is inserted into and secured by backplate 56. A second end of each guide 64 is inserted into and secured by a shaft support 67. Support 67 typically is a piece of material, such as aluminum, that is securely attached to baseplate 70. A positioner screw 66 is positioned between guides 64 and is used to move positioner 62. A first end of screw 66 is inserted through a bearing in backplate 56 and is attached to a positioner motor 69. A second end of screw 66 is inserted into and supported by shaft support 67. Motor 69 drives screw 66 to slidingly move positioner 62 along shaft 57. In the preferred embodiment, motor 69 is fine pitch stepper motor having a pitch of 0.9 degrees per step in order to facilitate accurate control of positioner 62.

Figure 6:
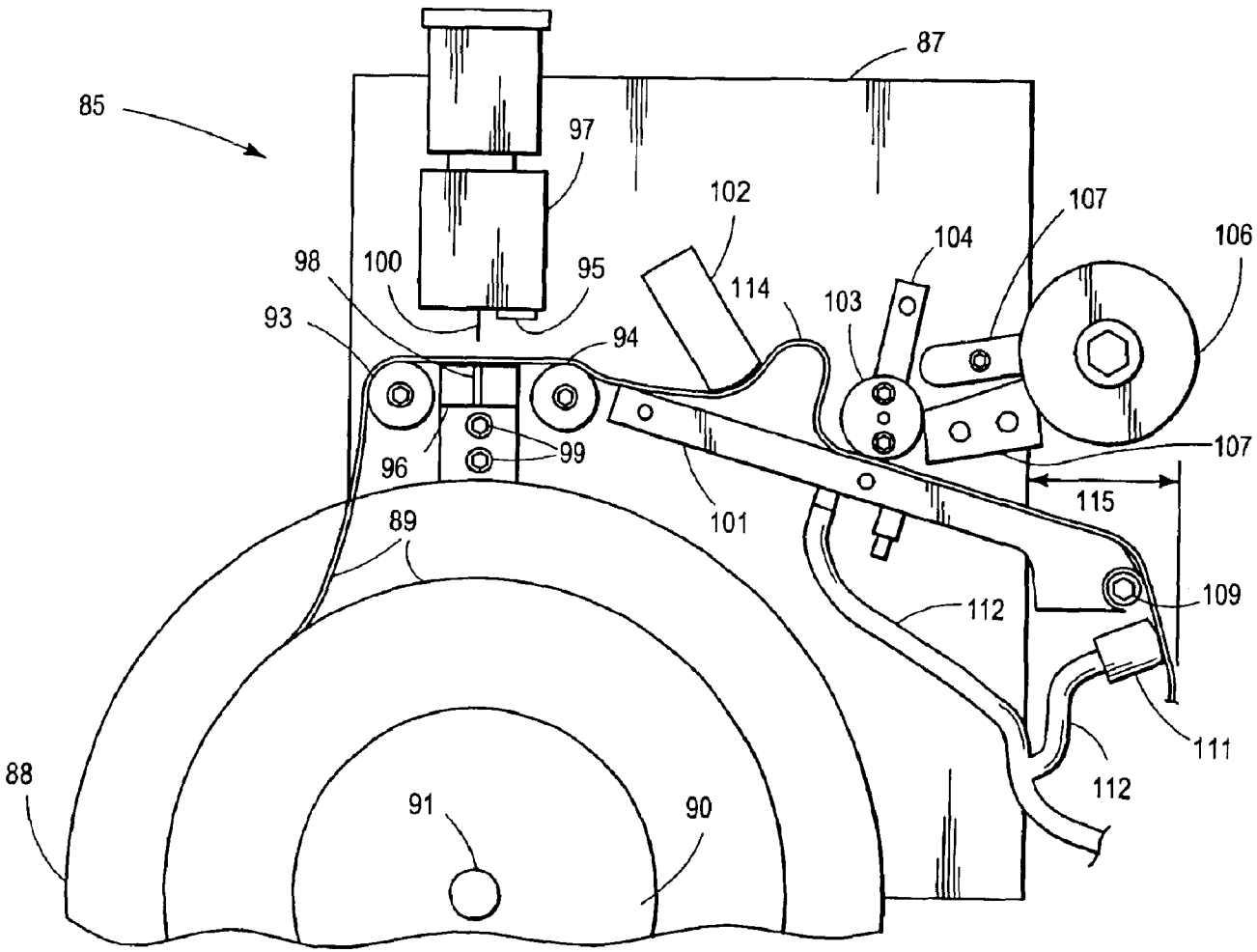
FIG. 6 schematically illustrates a reduced front elevation view of an embodiment of another portion of the automated reel changer of FIG. 1 in accordance with the present invention.

FIG. 6 schematically illustrates a reduced front elevation view of an embodiment of a portion of securing module 85 that is illustrated in FIG. 1.

Figure 7:
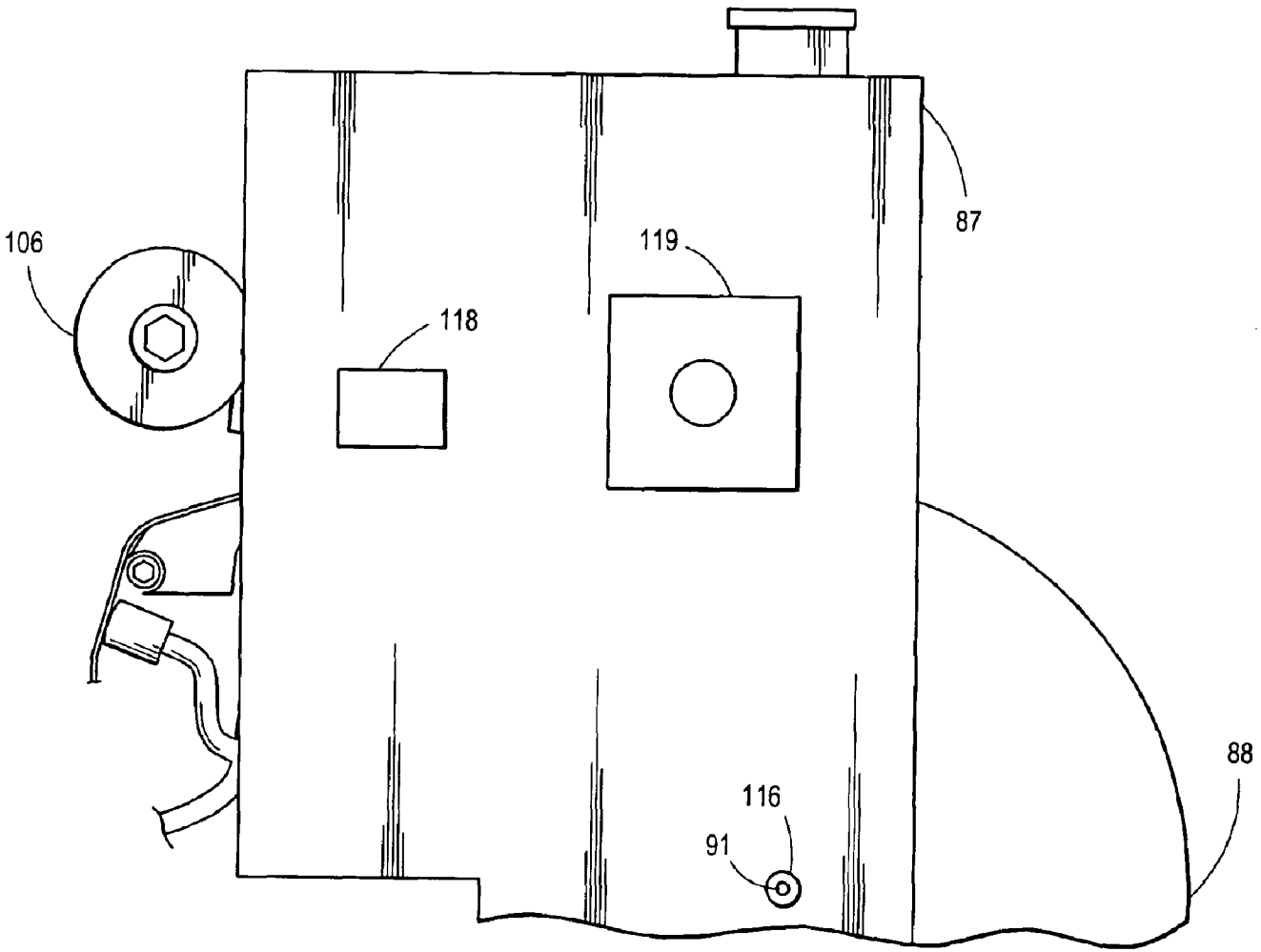
FIG. 7 schematically illustrates a rear elevation view of the embodiment of FIG. 6 in accordance with the present invention.

FIG. 7 schematically illustrates a reduced rear elevation view of an embodiment of a portion of securing module 85 that is illustrated in FIG. 1 and FIG. 6. For clarity, this description will have references to FIG. 7, FIG. 6, and FIG. 1. Module 85 is utilized to apply a securing device, such as a piece of tape, to a second end of tape 15 after tape 15 is wound onto receiving reel 80 to prevent tape 15 from unwinding. After tape 15 is wound onto reel 80, module 85 is moved into contact with tape 15. In order to facilitate the movement, motor 12 drives positioning screw 13. Screw 13 is inserted through a portion of a baseplate 86 so that the rotation of motor 12 moves module 85 along screw 13 until module 85 contacts tape 15.

To facilitate forming and attaching the securing device, module 85 includes a cutting actuator 97 that has a cutting blade 100 and a pressure foot 95, a cutting platform 96, a guide arm 101, a counting wheel 103, a release arm 102, a pressure roller 106 that is attached to backplate 87 by an attachment arm 107, and a vacuum port 111. Backplate 87 has a mounting shaft 91 that extends perpendicular to backplate 87 through a bearing 116 so that shaft 91 freely rotates. Typically an amount of a securing material 89 is wound into a roll on a spool 90 which is mounted onto shaft 91 so that material 89 may unwind from spool 90. The full roll of material 89 generally has a radius of about eleven centimeters (11 cm). In the preferred embodiment, material 89 is an anti-static adhesive tape typically referred to in the industry as blue sticky tape or blue armac tape. One example of such a tape is part number sn51-510e-408 available from Intertape Polymer Group Inc. of Bradenton Fla. A support plate 88 is attached to backplate 87 to assist in steadying spool 90 and material 89 as spool 90 rotates. Typically plate 88 is circular and has a diameter that is larger than the diameter of material 89 and spool 90. A cutting device is used to form material 89 into small strips of the securing device. The cutting device includes cutting actuator 97 and cutting platform 96. Platform 96 is attached to backplate 87 by screws 99. Material 89 passes from spool 90 over a front guide roller 93, passes between blade 100 and platform 96, and over an exit roller 94 as it is unrolled from spool 90. Front guide roller 93 and exit roller 94 are attached to backplate 87 adjacent to and substantially in the same plane as platform 96 so that the rolling surface of rollers 93 and 94 guide material 89 from spool 90 across platform 96 and to guide arm 101. Platform 96 has a slot 98 that is aligned to blade 100 so that material 89 may be cut as actuator 97 forces blade 100 to cut material 89. As blade 100 is forced through material 89, foot 95 is also pushed down to press material 89 against platform 96. It should be noted that blade 100 does not entirely cut material 89 but forms perforations in material 89. The perforations allow material 89 to easily tear after it has been attached to reel 80 as will be seen in more detail hereinafter. In the preferred embodiment, blade 100 removes about sixty per cent (60%) of the material along the perforation. When blade 100 perforates material 89, material 89 may stick to foot 95, so release arm 102 is activated to rotate release arm 102 one revolution counter-clockwise to pull material 89 across arm 101 and release material 89 from foot 95. A motor 119 (FIG. 7) is attached to the back side of backplate 87 to rotate arm 102. A shaft of motor 119 attaches to arm 102 to rotationally drive arm 102 through backplate 87. Arm 101 guides securing material 89 from exit roller 94 across arm 101 to a vacuum port 111. Guide arm 101 is attached to backplate 87 and extends laterally across backplate 87. Arm 101 also extends a distance 115 past the edge of backplate 87 so that securing material 89 may touch tape 15 without other portions of module 85 touching tape 15. Typically distance 115 is about five centimeters (5 cm). Arm 101 has a roller bearing 109 attached to the distal end of arm 101 to reduce friction as material 89 moves across arm 101 to vacuum port 111. Note that the top portion of backplate 87 is wider than a lower portion (See FIG. 1) in order to assist in contacting securing material 89 to tape 15 without the other portions of module 85 interfering with reel 80. Arm 101 has a vacuum that keeps material 89 in contact with arm 101 as material 89 passes across arm 101. Additionally, vacuum port 111 is attached to backplate 87 and is vertically aligned with the outer edge of arm 101 and holds material 89 vertically in order to facilitate attaching material 89 to tape 15. A vacuum line 112 is attached to port 111 and to arm 101. In the preferred embodiment it is about twenty three milli-meters (23 mm) from blade 100 across arm 101 to the end of port 111. A length of twenty three milli-meters of material 89 is sufficient to cover approximately thirty per cent (30%) of the circumference of tape 15 that is wound onto reel 80. As material 89 is pulled from spool 90 across arm 101 to port 111, counting wheel 103 counts the length of material 89 passing wheel 103 and provides a signal that is used to enable actuator 97 to cut material 89 after a first length of material 89 passes blade 100. Typically material 89 is formed into securing devices having a first length that is approximately equal to the length from blade 100 to the end of port 111. Wheel 103 is attached to backplate 87 by a pressure arm 104. In the preferred embodiment, a spring applies pressure to arm 104 to prevent wheel 103 from rotating clockwise. Wheel 103 has a counting device 118 attached to the back side of backplate 87 (FIG. 7). Device 118 forms a signal each time wheel 103 makes a complete revolution. The signal is used by processor 130 to count each revolution of wheel 103 and determine the length of material 89 that passes under wheel 103. In the preferred embodiment, device 118 is an optical sensor.

Prior to operating changer 10, the plurality of receiving reels including reels 80, 81, and 82 are manually loaded as a plurality of empty receiving reels onto a shaft 57. In the preferred embodiment fifteen empty receiving reels are loaded onto shaft 57. Shaft 57 is oriented so that sensor 61 is detecting protrusion 60 to ensure that reel 80 is oriented to receive tape 15. If a new spool 90 of blue sticky tape was loaded, material 89 is threaded through actuator 97 to port 111 and actuator 97 is manually activated once to cut material 89 into a first securing device. The vacuum from port 111 holds material 89 in place prior to being attached to tape 15. In the preferred operational embodiment, the handler provides an index output signal each time that the handler moves tape 15 one position toward changer 10. Processor 130 uses the index signals to assist in controlling changer 10 as described hereinafter. However, those skilled in the art will realize that sufficient information is available from the sensors of changer 10 to operate changer 10 with other signals and data if an index signal is not present.

In operation, changer 10 receives a signal from the handler that a first end of carrier tape 15 is exiting the handler and is moving toward module 20. Module 20 responsively rotates assembly 26 to a position to receive tape 15 into opening 44 and channel 29. The signal is also used to activate cylinder 49 to slide slider 47 along support 50 moving sensor 46 to a position in front of end 35 of body 28 so that tape 15 will pass directly under sensor 46 as the first end of tape 15 exits channel 29. Tape 15 is pushed by the handler toward changer 10 and enters body 28 through opening 44. The handler continues to index tape 15 through body 28 and channel 29. As tape 15 exits distal end 35, it moves under sensor 46 and is detected by sensor 46. The signal from sensor 46 is used by processor 130 to provide a signal to actuate gripper 32 and hold tape 15 under gripper 32 with a portion of tape 15 protruding from channel 29 past distal end 35. Typically tape 15 extends about fifteen to eighteen millimeters (15–18 mm) and preferably about seventeen millimeters (17 mm). After gripper 32 is actuated, cylinder 49 is de-activated to move sensor 46 and slider 47 away from distal end 35 of body 28 to facilitate inserting tape 15 into reel 80 without interference from sensor assembly 41. Arm 21 remains in place as the handler continues to index tape 15 toward changer 10 in order to accumulate slack in tape 15 prior to activating the drive motor to move arm 21. Since the drive motor moves arm 21 faster than the handler indexes tape 15, the slack facilitates moving head assembly 26 to reel 80. In other embodiments, the speed of the drive motor may be slower or controlled to match the speed that the handler indexes tape 15. After processor 130 receives about one hundred index signals, changer 10 activates the drive motor and rotates assembly 26 down to reel 80 causing the protruding portion of tape 15 to be inserted into the slot in reel 80. The one hundred indexes generally are about four hundred millimeters (400 mm) of tape 15. Arm 21 is formed to provide a radius for assembly 26 that ensures that the first end of tape 15 protruding from assembly 26 is perpendicular to the axis of reel 80 at the point of contact between tape 15 and reel 80. This ensures that tape 15 is properly inserted into reel 80. In the preferred embodiment, reel 80 has a radius of about 2.5 centi-meters from the center of shaft 57 to the insertion slot that receives the first end of tape 15. The outer radius of reel 80 is about nine centimeters (9 cm) and arm 21 has a radius of about twenty nine centimeters (29 cm) from end 35 to shaft 23. Sensor 19 (see FIG. 1) senses the position of arm 21 upon inserting tape 15 into reel 80 and de-activates cylinder 40 causing gripper 32 to release tape 15. After tape 15 is inserted, the signal from sensor 19 is used to activate the drive motor to rotate arm 21 and assembly 26 back to the starting position juxtaposed to the handler and is also used to enable module 55 to activate motor 68 to rotationally drive shaft 57 and reel 80 counter-clockwise to wind tape 15 onto reel 80 as tape 15 continues to exit the handler and travel through assembly 26.

After changer 10 has wound about ninety per cent (90%) of tape 15 onto reel 80, changer 10 enables motor 12 to slidingly move roller 106 into contact with tape 15 on reel 80. Typically, processor 130 counts the number of index signals from the handler to determine the ninety per cent point. The handler typically assembles tape 15 to contain either three thousand or ten thousand positions into which semiconductor devices are assembled. For the three thousand unit version of tape 15, the ninety per cent point typically is selected to be about two thousand seven hundred forty units (2740). To make roller 106 touch tape 15, processor 130 moves module 85 about ten and one-half milli-meters (10.5 mm) toward reel 80. At that point, port 111 is about ten millimeters (10 mm) from tape 15. Roller 106 contacts tape 15 and applies pressure to tape 15 to ensure that tape 15 is securely wound onto reel 80. In the preferred embodiment, the weight of roller 106 applies a pressure of about one hundred grams (100 G). When the last position of tape 15 exits the handler, changer 10 continues to rotate reel 80 until the second end of tape 15 that just exited the handler is wound onto reel 80 and reel 80 has rotated the second end to a position opposite to roller 106. In the preferred embodiment, processor 130 counts the index signals from the handler to determine that the second end of tape 15 has just exited the handler. In this preferred embodiment, the second end is about sixty nine centimeters (69 cm) from roller 106 at that time. Processor 130 calculates the number of rotations required for the circumference of reel 80 to wind that distance onto reel 80 and continues rotating reel 80 until all of tape 15 is wound and continues the rotation to position the second end of tape 15 opposite to port 111. Processor 130 then stops the rotation of reel 80 and activates motor 12 to move module 85 toward reel 80 until port 111 contacts tape 15 and attaches the securing device onto the second end of tape 15. Processor 130 then re-activates motor 68 to rotate reel 80 pulling material 89 from spool 90 across platform 96 and arm 101 to port 111 while attaching material 89 onto tape 15. Wheel 103 provides a signal to processor 130 for each rotation of wheel 103. Processor 130 uses this signal to determine the amount of material 89 that is pulled past wheel 103. As material 89 is pulled past wheel 103, the previous perforation made by blade 100 moves from under blade 100 across arm 101 until it eventually reaches the end of port 111. When a length of material 89 that is equivalent to the distance from blade 100 to the end of port 111 has passed under wheel 103, processor 130 enables actuator 97 to cut material 89. Actuator 97 pushes blade 100 thorough material 89 and at the same time foot 95 presses material 89 against platform 96. This holds material 89 in place while blade 100 performs the cutting and also holds material 89 in place against the rotational pressure from reel 80 causing material 89 to tear at the perforation that has been moved to port 111. Processor 130 then signals actuator 97 to release blade 100 and stops the rotation of reel by deactivating motor 68. Processor 130 activates motor 119 to rotate arm 102 counterclockwise to release any of material 89 that may be stuck to foot 95. This typically forms a loop 114 of material 89 next to arm 102 as illustrated in FIG. 6. Motor 12 is then activated to slidingly move module 85 back to a position that is away from reel 80 so that reel 80 may be removed from changer 10. Typically, processor 130 slidingly moves module 85 about twenty and one-half centimeters (20.5 cm) away from reel 80.

After module 85 is moved away from reel 80, motor 69 is activated to slidingly move positioner 62 along shaft 57 and push reel 80 off of shaft 57 and position reel 81 in a position to receive a second carrier tape 15 from module 20. Typically processor 130 sends a specified number of stepper pulses to motor 69 to move module 55 a distance sufficient to push reel 80 off of shaft 57. In the preferred embodiment, reel 80 is about eleven and one-half milli-meters (11.5 mm) thick, thus, module 55 is moved an equivalent amount to push reel 80 off of shaft 57. The process then repeats until all of the empty receiving reels are pushed off of shaft 57.

In view of all of the above, it is evident that a novel device and method is disclosed. Forming the changer to automatically insert the carrier tape into the receiving reel reduces assembly time and associated costs. Forming changer 10 to responsively apply the attachment device to the second end of tape 15 further reduces assembly time and associated costs. Forming changer 10 to responsively remove a full receiving reel and replace it with an empty receiving reel also reduces assembly time and associated costs.

What is claimed is:

1. An automated semiconductor tape and reel changing method comprising:

providing a tape and reel handler;

mounting a plurality of receiving reels onto a shaft of an automated reel changer;

positioning a first receiving reel of the plurality of receiving reels at a position on the shaft to receive a first carrier tape from the tape and reel handler;

receiving the first carrier tape from the tape and reel handler into a receiving opening of the automated reel changer and responsively grasping a first end of the first carrier tape;

inserting the first end of the first carrier tape into the first receiving reel then releasing the first end;

rotating the first receiving reel at a first rate while winding the first carrier tape onto the first receiving reel;

moving a securing device to contact a second end of the first carrier tape and responsively attaching the securing device to the second end of the first carrier tape after the first carrier tape is wound onto the first receiving reel;

stopping rotation of the first receiving reel after attaching the securing device; and removing the first receiving reel from the shaft while moving a second receiving reel of the plurality of receiving reels to the position to receive a second carrier tape from the tape and reel handler.

2. The method of claim 1 wherein inserting the first end of the first carrier tape into the first receiving reel then releasing the first end includes rotating the first end of the first carrier tape toward the first receiving reel until the first end is inserted into a slot in the first receiving reel.

3. The method of claim 1 wherein receiving the first carrier tape from the tape and reel handler into the receiving opening of the automated reel changer and responsively grasping the first end of the first carrier tape includes detecting the first end and responsively grasping the first end.

4. The method of claim 3 wherein detecting the first end and responsively grasping the first end includes moving a detector into a path of the first end and detecting the first end as the first end moves near the detector.

5. The method of claim 4 wherein detecting the first end and responsively grasping the first end includes activating a pneumatic cylinder to slide the detector into a path of the first end.

6. The method of claim 1 wherein moving the securing device to contact the second end of the first carrier tape and responsively attaching the securing device to the second end of the first carrier tape includes moving a pressure roller into contact with the first carrier tape that is wound onto the first receiving reel.

7. The method of claim 1 wherein moving the securing device to contact the second end of the first carrier tape and responsively attaching the securing device to the second end of the first carrier tape includes stopping the rotation of the first receiving reel, moving the securing device into contact with the first carrier tape, and re-activating rotation of the first receiving reel.

8. The method of claim 7 wherein stopping the rotation of the first receiving reel, moving the securing device into contact with the first carrier tape, and re-activating rotation of the first receiving reel includes moving an adhesive tape into contact with the first carrier tape.

9. The method of claim 8 wherein stopping the rotation of the first receiving reel, moving the securing device into contact with the first carrier tape, and re-activating rotation of the first receiving reel includes cutting a first length of the adhesive tape and winding the first length of the adhesive tape onto the first carrier tape.

10. The method of claim 1 wherein removing the first receiving reel from the shaft while moving the second receiving reel of the plurality of receiving reels to the position includes sliding the second receiving reel along the shaft and pushing the first receiving reel off of the shaft.

11. An automated semiconductor tape and reel changing method comprising:

providing a tape and reel handler;

mounting a plurality of receiving reels onto a shaft of an automated reel changer;

positioning a first receiving reel of the plurality of receiving reels at a position on the shaft to receive a first carrier tape from the tape and reel handler;

receiving the first carrier tape from the tape and reel handler into a receiving opening of the automated reel changer and responsively grasping a first end of the first carrier tape;

inserting the first end of the first carrier tape into the first receiving reel then releasing the first end;

rotating the first receiving reel at a first rate while winding the first carrier tape onto the first receiving reel;

moving a securing device to contact a second end of the first carrier tape and responsively attaching the securing device to the second end of the first carrier tape after the first carrier tape is wound onto the first receiving reel;

stopping rotation of the first receiving reel after attaching the securing device; and removing the first receiving reel from the shaft while moving a second receiving reel of the plurality of receiving reels to the position to receive a second carrier tape from the tape and reel handler by turning a positioning screw with a motor for sliding the second receiving reel along the shaft and pushing the first receiving reel off of the shaft.

12. A method of forming an automated semiconductor tape and reel changer comprising:

forming a rotationally driven reel shaft having a length for receiving a plurality of receiving reels;

forming a loader module to receive a first carrier tape and responsively insert a first end of the first carrier tape into a first receiving reel of the plurality of receiving reels;

forming a securing module to contact the first receiving reel, attach a securing device, and disengage from the first receiving reel; and forming a reel positioner to eject the first receiving reel from the rotationally driven reel shaft and position a second receiving reel of the plurality of receiving reels to receive another carrier tape from the loader module.

13. The method of claim 12 wherein forming the loader module to receive the first carrier tape and responsively insert the first end of the first carrier tape into the first receiving reel of the plurality of receiving reels includes forming a rotationally driven receiving chamber to receive the first carrier tape, and insert the first carrier tape into the first receiving reel.

14. The method of claim 12 wherein forming the rotationally driven receiving chamber to receive the first carrier tape, and insert the first carrier tape into the first receiving reel includes attaching the receiving chamber to a pivot arm that rotates around a shaft.

15. The method of claim 14 further including attaching a drive motor to the shaft.

16. The method of claim 12 wherein forming the securing module to contact the first receiving reel, attach the securing device, and disengage from the first receiving reel includes coupling a motor to a drive screw and coupling the drive screw to the securing module.

17. The method of claim 12 wherein forming the securing module to contact the first receiving reel, attach the securing device, and disengage from the first receiving reel includes attaching a cutting device to the securing module to perforate the securing device, and attaching a counting device to the securing module.

18. A method of forming an automated semiconductor tape and reel changer comprising:

forming a rotationally driven reel shaft having a length for receiving a plurality of receiving reels;

forming a loader module to receive a first carrier tape and responsively insert a first end of the first carrier tape into a first receiving reel of the plurality of receiving reels;

forming a securing module to contact the first receiving reel, attach a securing device, and disengage from the first receiving reel; and slidingly attaching a plate to the rotationally driven reel shaft and coupling a positioning screw to slidingly move the plate along the rotationally reel driven shaft to eject the first receiving reel from the rotationally driven reel shaft and position a second receiving reel of the plurality of receiving reels to receive another carrier tape from the loader module.

19. An automated semiconductor tape and reel changer comprising:

a loader module having a loader arm for rotating about a pivot point of the loader arm and having a head assembly attached to a first end of the loader arm;

a rotationally driven reel shaft positioned perpendicular to an arc circumscribed by rotation of the loader arm, the rotationally driven reel shaft having a length for receiving a plurality of receiving reels wherein an end of the rotationally driven reel shaft is distal from the arc;

a reel positioner slidingly attached to the rotationally driven reel shaft between the end of the rotationally driven reel shaft and the arc; and a securing module slidingly positioned radially to a circle circumscribed by rotational motion of the rotationally driven reel shaft.

20. The automated semiconductor tape and reel changer of claim 19 wherein the securing module includes a drive screw coupled to slide the securing module to the plurality of receiving reels and away from the plurality of receiving reels.

* * * * *